US005934691A

United States Patent [19]

Stivali

[11] Patent Number: 5,934,691

[45] Date of Patent: Aug. 10, 1999

[54] ROLLER SKATE BRAKING

[76] Inventor: Gary C. Stivali, 15 Tern Cove, Safety Harbor, Fla. 34695

[21] Appl. No.: 08/810,873

[22] Filed: Mar. 5, 1997

Related U.S. Application Data

[63] Continuation-in-part of application No. 08/594,140, Jan. 1, 1996, abandoned.

[51] Int. Cl.[6] ..... A63C 17/14

[52] U.S. Cl. ..... 280/11.2; 280/11.22; 188/5

[58] Field of Search ..... 280/11.2, 11.19, 280/11.21, 11.22, 11.25, 11.23; 188/5, 25, 74, 80

[56] References Cited

U.S. PATENT DOCUMENTS

| | | | |
|---|---|---|---|
| 920,848 | 5/1909 | Eubank, Jr. | 280/11.2 |
| 926,646 | 6/1909 | Eubank, Jr. | 280/11.2 |
| 5,183,275 | 2/1993 | Hoskin | 280/11.2 |
| 5,280,930 | 1/1994 | Smathers et al. | 280/11.2 |
| 5,411,276 | 5/1995 | Moldenhauer | 280/11.2 |
| 5,755,450 | 5/1998 | Ellis et al. | 280/11.2 |

*Primary Examiner*—Lanna Mai
*Assistant Examiner*—Bridget Avery
*Attorney, Agent, or Firm*—Charles A. McClure

[57] ABSTRACT

Roller skate braking actuated by the skater, by hand or foot, and aided mechanically, hydraulically, and/or electrically, whether in actuation, linkage, or braking retardation of at least a rearmost skate-supporting wheel. A braking roller having a concave portion fitting closely against the convex wheel surface is retarded to slow or stop the wheel and the skate, however the skater so actuates it.

11 Claims, 5 Drawing Sheets

ROLLER SKATE BRAKING

This is a continuation-in-part of my allowed application, Ser. No. 08/594,140, filed Jan. 1, 1996, to be abandoned upon the filing of this application.

TECHNICAL FIELD

This invention relates to braking of roller skates, especially (but not limited to) in-line skates, concerning particularly wheel braking manually actuatable to whatever extent the skater wishes.

BACKGROUND OF THE INVENTION

For whatever reason, roller skates having wheels arranged in a single line have largely displaced those with wheels at four corners of the skates. So-called "in-line" skates customarily have three to five (or more) wheels arranged fore-to-aft and are less stable and more difficult to stop than their four-wheel-cornered predecessors.

Nowadays in-line skates are usually braked by tipping the front end upward, sacrificing both precision and safety, in order to press a brake pad on the aft end down onto the underlying skating surface. See an improvement by Pellegrini and Tormens in U.S. Pat. No. 5,511,804.

Other inventors received U.S. patents for such contributions to skate brakes as (a) brake shoe against tire/wheel perimeter, Slusher U.S. Pat. No. 1,687,739, Mirick U.S. Pat. No. 1,801,205, Means U.S. Pat. No. 2,027,427, Riggs U.S. Pat. No. 4,300,781, Krantz U.S. Pat. No. 4,805,936, Dettmer U.S. Pat. No. 5,171,032, Mitchell U.S. Pat. No. 5,253,882; (b) brake against another part of wheel, Krausz U.S. Pat. No. 4,076,266, Scheck U.S. Pat. No. 4,108,451, Smathers U.S. Pat. No. 5,280,930; (c) brake shoe against aiding wheel forced onto the underlying pavement, Klukos U.S. Pat. No. 5,511,803; (d) braking roller against tire/wheel perimeter, Eubank U.S. Pat. No. 920,848 and U.S. Pat. No. 926,646, Murga U.S. Pat. No. 5,069,462, Hoskin U.S. Pat. No. 5,183,275, Moldenhauer U.S. Pat. No. 5,411,276. The foregoing constitutes my best present knowledge of the skate art. The bicycle art provides some analogous or counterpart—yet different—features.

SUMMARY OF THE INVENTION

My invention relates in part to the last of those categories, but it differs in structure and functioning from what the inventors there (and others) did—as will be apparent from this specification.

A primary object of the present invention is to enhance safety of roller skating generally and of in-line skating in particular.

Another object of this invention is to provide roller skaters with more precise control of braking their skates.

A further object of the invention is to provide roller skaters with various mechanical, hydraulic, and electric braking actuations.

Yet another object of the invention is to provide skate braking backup capability in the event of failure of primary braking action.

A still further object of this invention is to accomplish the foregoing objects economically and without undue complexity.

In general, the objects of the present invention are attained, as in an in-line roller skate, by skater-actuated retarding means to brake preferably a rearmost one of the skate-supporting wheels. Linkage interconnecting to the retarding means may be selected to be mechanical or hydraulic or electrical, or some combination thereof. The retarding means preferably includes a braking roller, normally biased into a stationary (or free-running) condition, but pressed by the linkage into frictional braking contact with at least a rearmost wheel to slow or stop the skate pursuant to actuation by the skater.

Manipulation is a preferred method of brake actuation, but some skaters may prefer to brake by boot movement via leg action instead. Boot actuation also is useful for supplemental or backup braking. The present invention enables either and/or both kinds of actuation.

Other objects of this invention, along with various methods and means for attaining the various objects, will become apparent from the following description and the accompanying diagrams of preferred embodiments, presented by way of example rather than limitation.

DESCRIPTION OF EMBODIMENTS OF THE INVENTION

Figure 1:
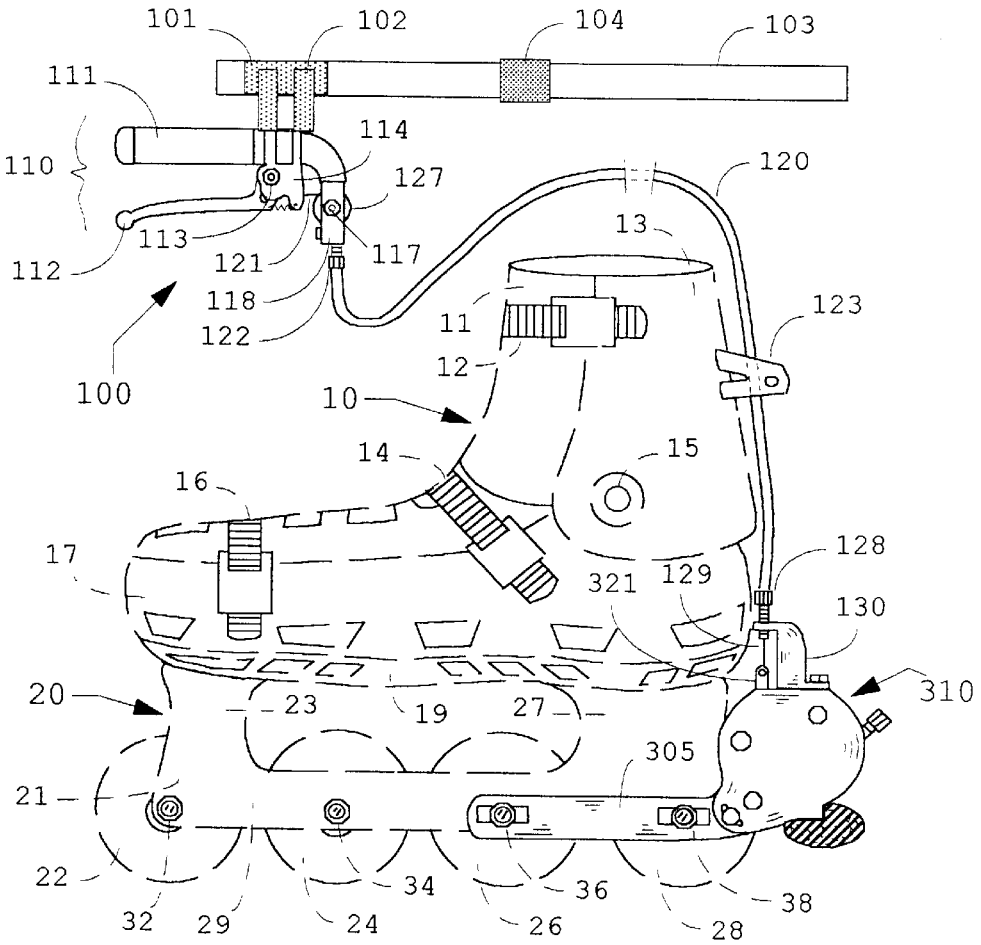
FIG. 1 is a side elevation of a hand-grip-actuated mechanically linked embodiment of the present invention, including partly housed retarding means plus broken-line showing of skater's boot and skate.

The structural features and their arrangement in the diagrams designated by Fig. numbers are described structurally at the outset. Operational description (except for brief comment) is deferred until completion of the structurally description of all Fig. views. This enables reference numbers to be omitted from the operational account where their presence would be distracting rather than advantageous.

Features illustrated in other than phantom or broken lines in a given Fig. have reference numbers, most of whose first digits are conveniently that Fig, number (omitting any added letter). Where a Fig. is devoted to expansion of a given featured group, the leading digit of that given Fig. may designate that group and its features in one or more other Figs. in which that group is less detailed.

Phantom (broken-line) illustration 20 of a skater's boot and in-line skate is substantially invariant in FIGS. 1, 2, 4, 5, and 6. Those features are identified preliminarily by reference to FIG. 1, and are not referred to in descriptions of successive views, unless for some particular reason, such as a modification for attachment of linkage of this invention. Boot 10 has ankle-encompassing upper 11 with overlapping rear cuff portion 13 provided with closure snap 15.

Closure straps 12, 14, and 16 help to secure the boot on the skater's foot (not shown). Boot sole 19, underlying and secured to vamp 17 toe and heel portions, is secured on top of (and obscures) the skate foot-rest. Skate frame 21 has (besides such horizontal foot-rest) front flange 23 and rear flange 27 upstanding from blade 29, which carries supporting wheels 22, 24, 26, 28 in that order, from its forward to its aft end, on respective transverse axles 32, 34, 36, 38. Retaining means at axle ends are cut away in this view.

FIG. 1 shows, in side elevation (with phantom boot and skate), hand-grip-actuated mechanically linked embodiment 100 of this invention. Hand-grip actuation means 110 is made up of handle 111 and pivot grip 112 mounted on pivot pin 113 in handle flange 114. Flexible retaining strap 101 with pair of connectors 102 enables the hand-grip to be held on the skater's belt 103, for ready manipulation by the skater. Belt buckle 104 connects the belt ends, as half of the belt is shown, with the other half looped behind the plane of the diagram. Flexible conduit 120 attaches at its upper end fitting 122 to handle L-end housing 118 and at its lower end 128 to bracket 130 upstanding from retarding means housing 310, connected to the skate frame by flange 305 slotted to receive axle retainers. Cable 121 is covered (except at its protruding ends) by the conduit. At its upper the cable end passes around roller 127 secured by pivot pin 117 retained in housing 118 and is secured to pivotal grip 112, whereas at its lower end 129 the cable is secured to an end of link 321 protruding upward from retarding means housing 310. In between, the conduit is secured to boot cuff 13 by staple-like cleat 123, although the boot could well be modified, as by a built-in fitting, possibly removable, as more elegant retaining means for the conduit.

Figure 2:
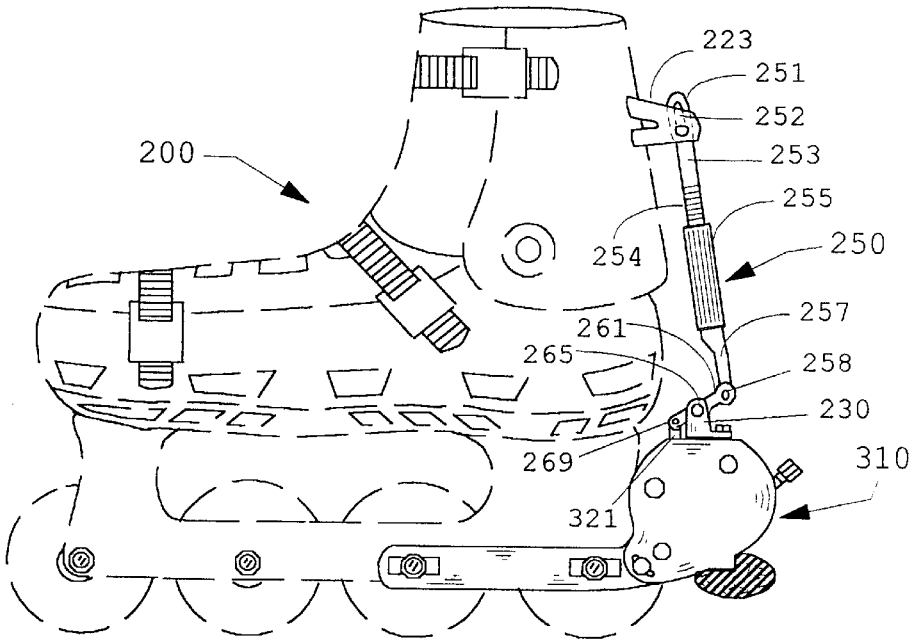
FIG. 2 is a similar side elevation of a boot-actuated mechanically linked embodiment of the invention.

FIG. 2 shows, also in side elevation, boot-actuated mechanically linked embodiment 200 of this invention, enabling mechanical force or position amplification. This embodiment is structured so that skater leg actuation of the boot cuff replaces the previously shown hand-grip actuation. As already noted, the boot and skate reference numbers remain unchanged, so are mentioned only sparingly in the description of this view—or indeed of any subsequent Fig. Boot cuff 13 is adapted to function as the actuation means, by backward slanting of the skater's ankle to move staple-like cleat 223 backward and downward accordingly. Linkage 250 interconnects the actuation means to link 321 protruding upward at the top left of retarding means 310 (much as the FIG. 1 linking cable connected).

Linkage 250 includes length-adjustable rod means fitted to the particular boot plus lever means as a mechanical amplifier of the rod movement, as follows. The rod means includes upper rod 253 with its top 251 provided with short longitudinal slot 252 engaging cleat 223, and with threaded lower end 254 engaging internally threaded upper end 255 of lower rod 257 whose lower end 257 has pivot pin 258 through it. Also connected to that pivot pin is upper end 261 of the amplifier lever, pivoted on pin 265 supported by bracket 230 upstanding from retarding means housing 310. Amplifier lever lower end 269 connects pivotally to link 321 from the adapter housing.

Figure 3A:
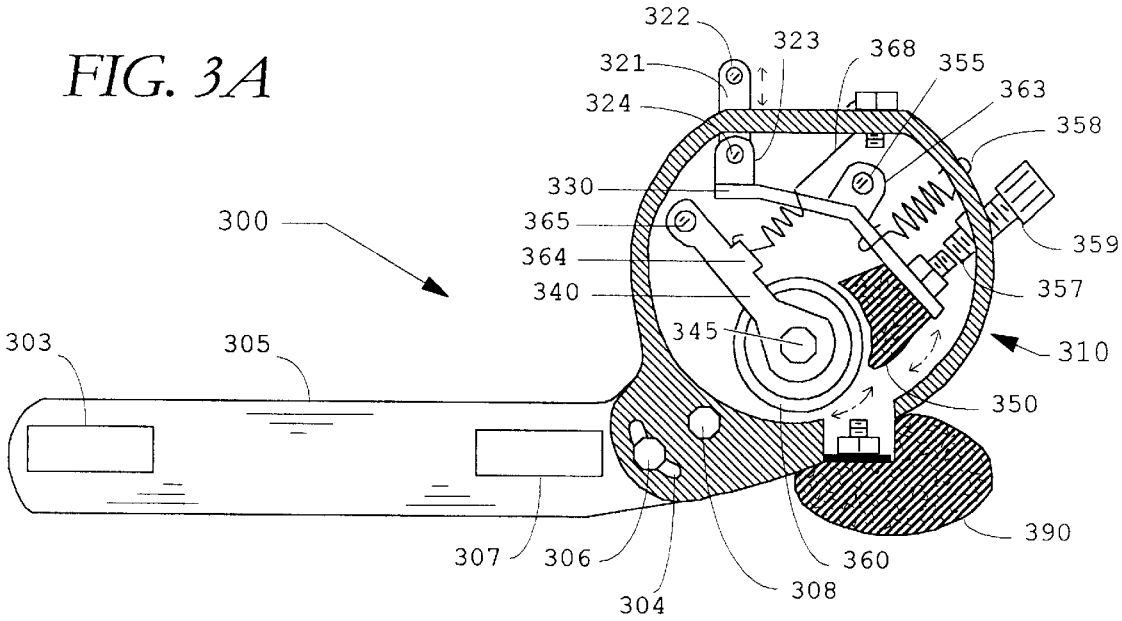
FIG. 3A is a side elevation.
Figure 3B:
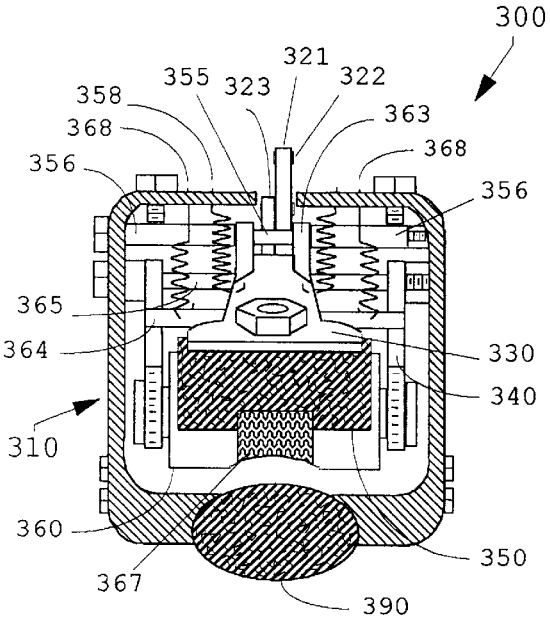
FIG. 3B is a rear elevation.
Figure 3C:
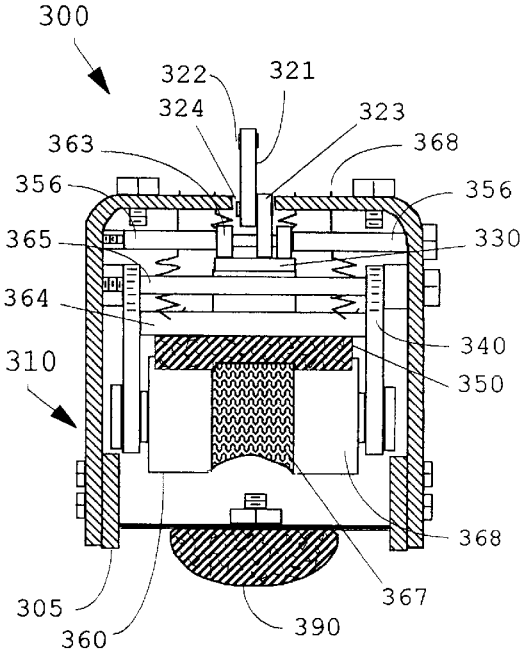
FIG. 3C is a front elevation, each with housing shown in section, of an embodiment of retarding means, shown covered in FIGS. 1 and 2.

FIGS. 3A, 3B, and 3C show skate adjunct assembly 300, in side elevation, rear elevation, and front elevation, respectively, each with retarding housing sectioned away, featuring a first embodiment of retarding means 310, having brake shoe 350 and braking roller 360. Ellipsoidal pad 390 below the retarding means housing, protects it from possible abrasive contact with the skate-supporting surface.

Entire housing 310 is secured to pair of mounting flanges 305 (one visible in FIG. 3A) by screw 308, and is adjustable through a small cutout arc 304 about set screw 306, both screws being adapted to secure the housing at a whatever adjustment setting is preferred. Link 321, adjustable up and down (see broken arrow) on external pivot 322, connects by internal pivot 324 via ear 323 to the upper end of angled swing arm 330, which is pivoted on cross-pin 355 via bracket 363 and is centered by pair of flanking sleeves 356. This swing arm carries brake shoe 350 on its lower end. Except as upward motion of the link moves the angled swing arm downward (arcuate broken arrows), pair of bias springs 358 (one visible in FIG. 3A, two in FIG. 3B), extending from brake pad crossbar 365 to the adjacent wall of housing 310, urge the brake pad at the lower end of the swing arm toward the wall and to a rest position determined by contact with adjusting screw 357—which can be set by turning its external knurled head 359.

Braking roller 360 is mounted on axle 345 at the far end of flanking straight swing arms 340 (one in FIG. 3A, two in FIG. 3B) pivoted on crossbar 365. The roller is biased into contact with the brake pad by pair of springs 368 (one in FIG. 3A, two in FIG. 3B) extending from crossbar 364 to the adjacent wall of housing 310. The cylindrical braking roller is movable (arcuate broken arrows) into contact with a skate wheel (not shown here), as by displacement of the brake pad swing arm when link 321 is lifted. The center one-third of the braking roller surface contacting the skate wheel, is knurled and concave to improve its frictional contact with the convex skate wheel perimeter. The flanking non-contacting thirds 368 of the braking roller surface remain smoothly cylindrical.

Figure 4:
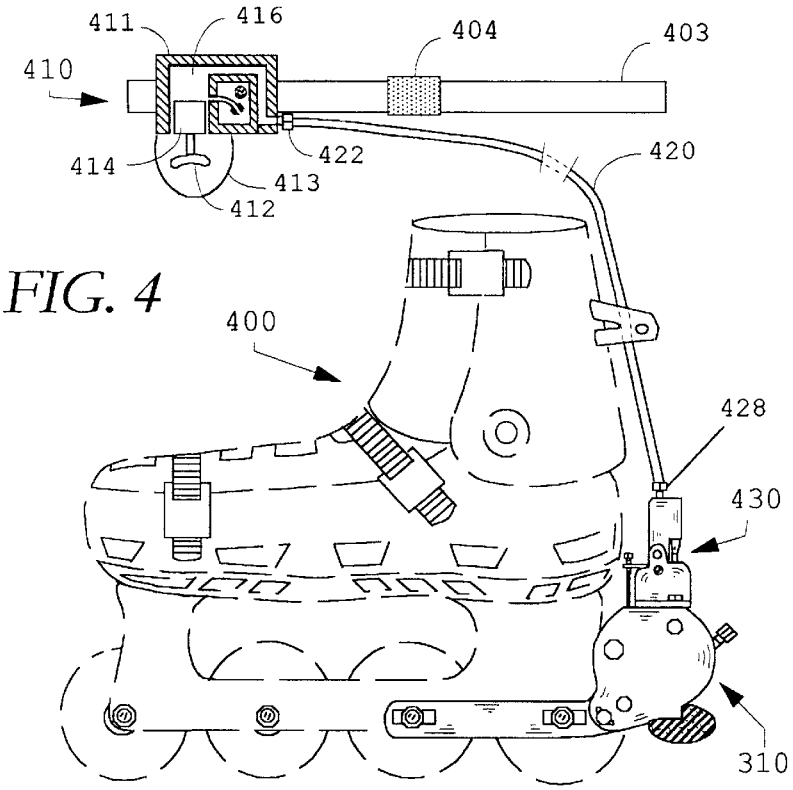
FIG. 4 is a side elevation of a hand-grip-actuated hydraulically linked embodiment of this invention, including retarding means plus broken-line showing of skater's boot/skate.
Figure 4A:
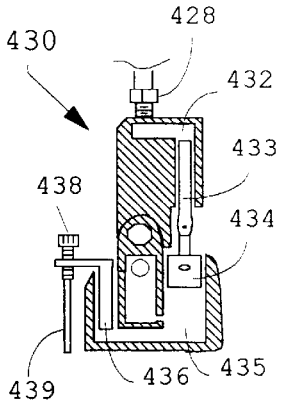
FIG. 4A is an enlarged medial side sectional elevation of linking hydraulic amplifier affixed onto the retarding means in FIG. 4.

FIG. 4 shows, in side elevation, hand-grip-actuated hydraulically linked embodiment 400 of this invention, including retarding means plus broken-line showing of skater's boot/skate; and FIG. 4A shows hydraulic amplifier 430 thereof, in side sectional elevation and on an enlarged scale, as mounted on the retarding means housing.

Hand-grippable actuation means 410 differs from previously hand-gripped actuation means 110 by substituting (for the handle bar and pivoted hand-grip with cable and linking conduit) hydraulic actuation means 410 linked by hose 420 to hydraulic amplifier 430 and on to retarding means 310, etc.

Belt 403 with buckle 404 carries small cylindrical hydraulic housing 411 of the actuation means, designed for hand gripping and having control plunger 414 in chamber 416 with actuating push button 412. Finger guard 413 loops over the button. Housing 411 is sectioned away to reveal that the short travel of the plunger is effective to produce a desired displacement of liquid into near end 422 of the hose line and a like amount out of far end 428 into hydraulic amplifier 430. The skater, by pressing on the push button overcomes biasing of the brake pad and braking roller in retarding means 310, and thereby slows or even stops the skate as desired.

FIG. 4A shows amplifier 430 in detailed medial section. Small inlet cylinder 432 with piston 433 connects to larger outlet piston 434 in chamber 435, which has even smaller outlet piston 436 with an offset arm connectable by adjusting screw 438 on the end of link 439 for connection to the adapter means—as via link 321. Clearly the fluid displacement provided by the skater's finger movement has been magnified by the amplifier before operating the retarding means.

Figure 5:
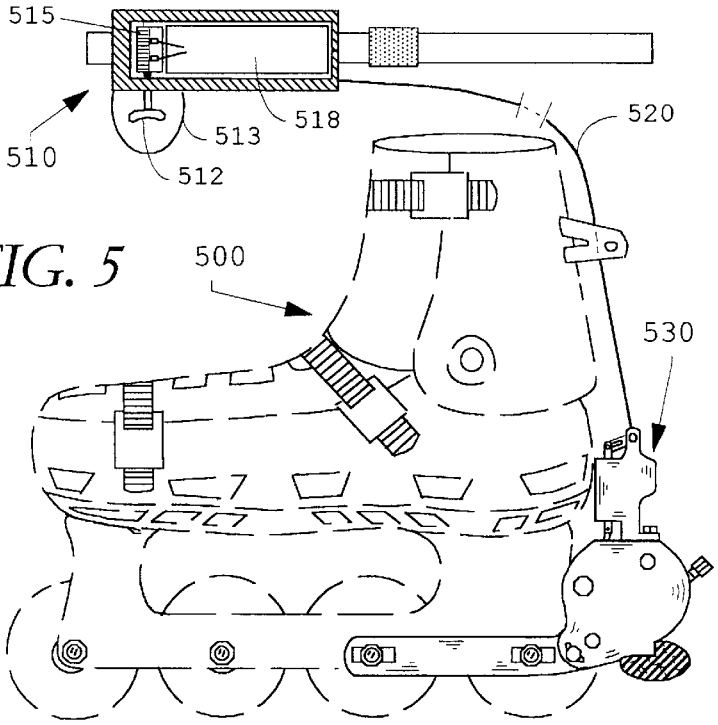
FIG. 5 is a side elevation, partly cut away and sectioned, of a hand-grip-actuated electrically linked embodiment of the invention, with retarding means plus (broken-line) skater's boot/skate.
Figure 5A:
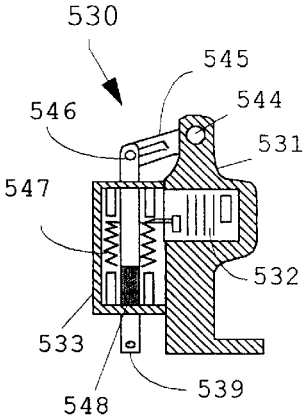
FIG. 5A is an enlarged medial side sectional/cut away view of linking electrical servo-amplifier on the FIG. 5 retarding means.

FIG. 5 shows, in side elevation, partly cut away and sectioned, hand-grip-actuated electrically linked embodiment 500 of the present invention, with an embodiment of retarding means plus (broken-line) skater's boot/skate; and FIG. 5A shows, in side sectional elevation, electrical servo-amplifier 530 of this embodiment in enlarged detail as located on top of the housing of the retarding means.

Hand-held actuation means 510 of this all-electrical embodiment outwardly resembles preceding hydraulic look-alike means (410), but push button 512 covered by finger guard 513 presses against pressure-sensitive component 515 to control conventional associated circuitry (not shown) suitably energized by battery 518 to signal servo-amplifier 530 accordingly via linking electrical line(s) 520.

FIG. 5A shows servo-amplifier 530 in medial section, including upstanding frame 531 hollowed about circuitry 532 and having pivot pin 544 at its top. Link 545 is pivoted to that pin at one end and to pin 546 at its other end, which connects to vertical rod 539 in subhousing 533. The smooth mid-portion of the rod in its normal position is surrounded by coil 547. Shaded portion 548 of the rod differs from the rest of the rod by being magnetically permeable or ferromagnetic. That portion is near the end of the rod where it is connectable to the retarding means link and is normally below the coil location. It will be understood that actuation by the skater energizes coil 547 and draws the ferromagnetic portion of rod 539 up within the coil, thus raising the retarding means link, overcoming the bias of retarding means components toward non-braking position. The resulting braking is dependent upon the degree of actuation, of course, but the servo-amplification reduces the force required from the skater to produce whatever degree of braking is desired.

Figure 6:
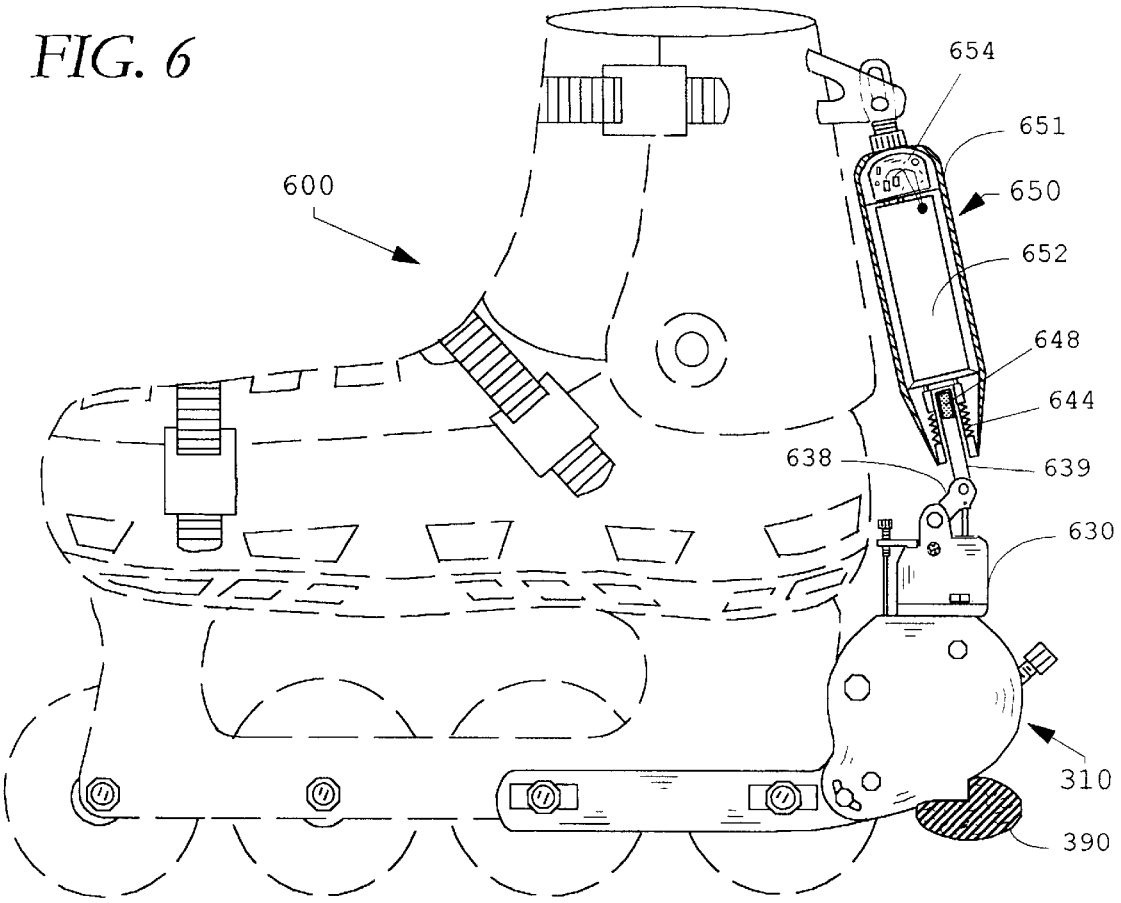
FIG. 6 is a side elevation, partly sectioned, of a hand-grip-actuated electrically linked embodiment of this invention, including linking hydraulic amplifier mechanism connected between the boot and the retarding means, plus skater's boot/skate broken-line showing.

FIG. 6 shows, in side elevation, partly sectioned, composite embodiment 600 of this invention. Hand-grip actuation means 610, shown in detail in FIG. 6A, electrically actuates radio transmission linkage to an embodiment of retarding means by radio reception and boot-linkage including hydraulic amplifier 630, shown on an enlarged scale in FIG. 6B. Skater's boot/skate apparatus appears as before. Receiver circuitry 654 is in the upper end of housing 651 of linkage 650. The housing is occupied mainly by one or more batteries 652, which energize coil(s) 644 of a servo-amplifier having protruding rod 639 with ferromagnetic shaded portion 648 near the bottom end.

Figure 6A:
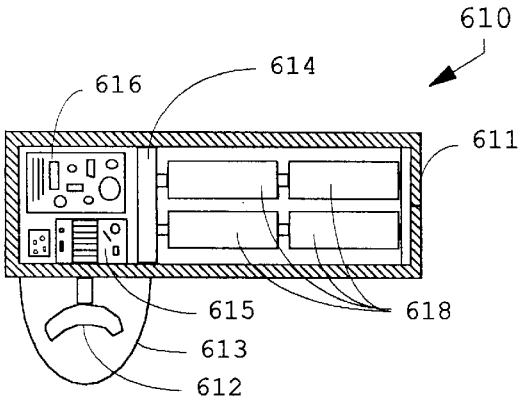
FIG. 6A is a side sectional elevation of a hand-grip actuated radio transmitter for use with the embodiment of FIG. 6.

FIG. 6A shows, mainly in sectional elevation, actuation means 610 having housing 611 with push button 612 covered by finger guard 613 located to press against pressure-sensitive component 615. Conventional associated circuitry 616 is energized, to an extent dependent upon such manual pressure, by batteries 618 in a compartment separated from the circuitry by intervening wall 614, to broadcast the skater's actuation signals to and through electrical linkage.

Figure 6B:
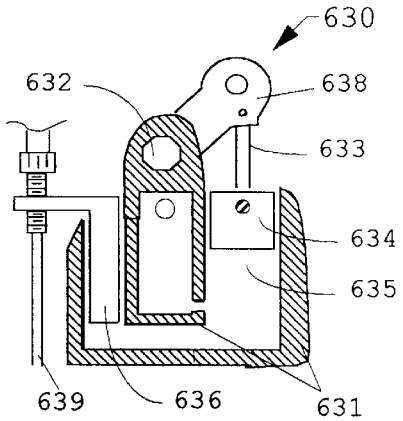
FIG. 6B is an enlarged side sectional view of linking hydraulic amplifier mechanism affixed onto the retarding means in FIG. 6.

FIG. 6B shows, in side sectional elevation, an enlarged side sectional detail of hydraulic amplifier 630, as enabled here, for mounting on housing of the retarding means. Except for its mechanical (instead of hydraulic) input, this amplifier is somewhat similar to hydraulic amplifier 430 in FIG. 4A. Here link 638 is pivoted on pin 632 journaled in amplifier housing 631 and carrying at its available end piston rod 633. Piston 634 in cylinder 635 forces liquid into an adjacent cylinder having piston 636, connected externally to adjustable link 639, for connection to link 321 of retarding means 310 (or equivalent). Lifting of link 639 counteracts the brake-off bias as explained in connection with FIGS. 3A, 3B, and 3C.

In the event of failure of radio actuation and/or linkage in the latter embodiment, the skater could boot-actuate the retarding means via the physical linkage between boot and retarding means.

Figure 7A:
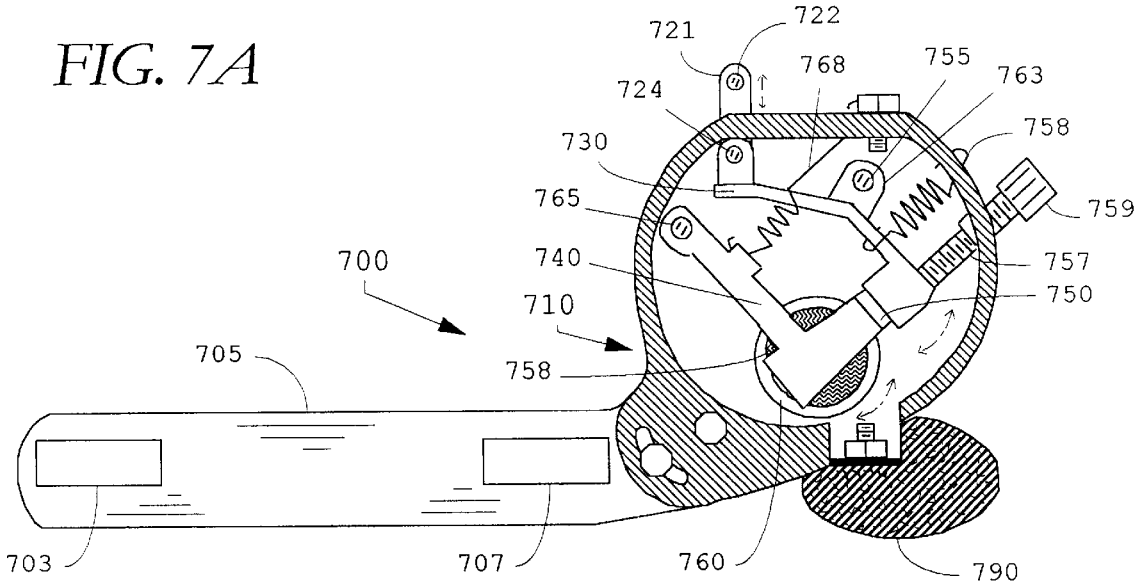
FIG. 7A is a side elevation.
Figure 7B:
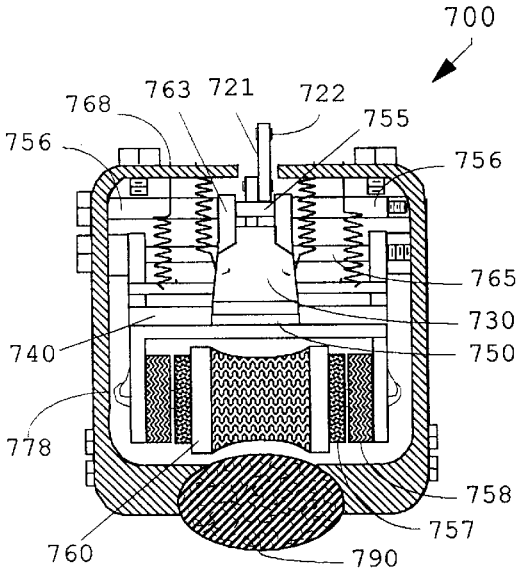
FIG. 7B is a rear elevation.
Figure 7C:
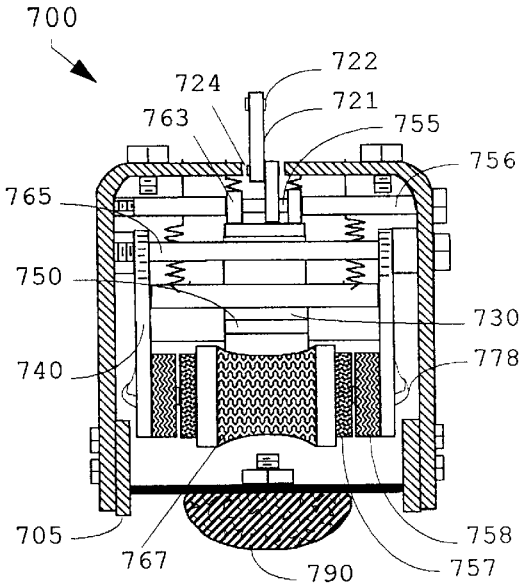
FIG. 7C is a front elevation, each with housing shown in section, of another embodiment of retarding means, similarly useful

FIGS. 7A, 7B, and 7C show retarding means embodiment 700, in side elevation, rear elevation, and front elevation, respectively, each with housing shown in section, as a convenient and equivalent alternative to retarding means embodiment 300 (shown in comparable FIGS. 3A, 3B, and 3C) whenever and wherever electrical actuation and/or linkage is preferable. Parts in this latter retarding means embodiment that are functionally and/or structurally equivalent to those of the previous embodiment are identified by reference numbers differing from the previous numbers only in the prefixed 7 (vice 3) to facilitate identification and may not be expressly so described. Link 721, adjustable up and down (adjacent broken arrow) on external pivot 722, connects by internal pivot 724 to the upper end of angled swing arm 730, which is pivoted on cross-pin 755 and carries bumper pad 750 on its lower end. Except as upward motion of the link moves the angled swing arms oppositely (adjacent broken arrows) pair of bias springs 758 (one visible in FIG. 7A, two in FIG. 7B) urge the lower end of the swing arm toward the adjacent wall of housing 710 and to a rest position determined by the position of adjusting screw 757 set by turning its external knurled head 759. Except as it is moved (adjacent broken arrows) by such displacement of the bumper pad swing arm, braking roller 760 on the far end of straight swing arms 740 (one in FIG. 7A, two in FIG. 7B) pivoted on cross-pin 765 is biased similarly toward the housing wall by pair of springs 768 (one in FIG. 7A, two in FIG. 7B) much as was illustrated in the prior embodiment of FIGS. 3, 3A, and 3B.

However, in this FIG. 7, 7A, and 7B embodiment, electromagnetic braking is employed—instead of the previous mechanical friction. The skater is provided with electrical actuation means and with either direct linkage by electrical leads, much as in the embodiment of FIG. 5, or by radio linkage, much as in the embodiment of FIG. 6. Braking roller 760 has pair of cylindrical members 757 flanking and affixed to it, flanked in turn by pair of cylindrical coils 758 closely spaced thereto but affixed to swing arms 740 and provided with electrical leads 778 from the available batteries (not shown).

Regardless of the type of electrical actuation and linkage, energization of fixed coils 758 induces braking retardation of the affixed cylinders 757, retarding and even stopping rotation of the roller—and that of a contiguous skate wheel, as is the objective. A simple description suffices as self-evident without illustration.

The hollow cylinders preferably surround projections, such as spokes or vanes affixed to roller-supporting crossbar 345, and preferably contain magnetically permeable particulate material, such as iron filings. Energizing the closely adjacent coils aligns the particulates more or less strongly, impairing their rotation and rotation of the braking roller and that of a contiguous skate wheel. Alternative forms of electromagnetic clutch or brake are known, one or another of which may be substituted in this exemplary embodiment. The retarding roller itself could perform the role of cylinders 757.

It will be understood that this or the previously described and illustrated retarding means may be substituted in combination with various of the actuation and/or linkage means, as may be preferable. The present invention greatly enlarges and extends a skater's choice of main and/or backup braking means for any type of roller skate.

Operation of the apparatus of this invention is readily understood from the foregoing description and the accompanying diagrams, as supplemented by the following operational summary. Lifting of the protruding link of the retarding means (either embodiment) forces the concave knurled braking wheel surface against the convex skate wheel perimeter in preferably non-slipping frictional contact. As the braking wheel is slowed at the same time, whether by frictional contact with the brake pad or by equivalent electromagnetic effect, the skate wheel is slowed/stopped as the skater so actuated.

In a hand-grip-actuated mechanically linked embodiment of FIG. 1 or the boot-actuated mechanically linked embodiment of FIG. 2, and the hand-grip-actuated hydraulically linked embodiment of FIG. 4, the brake pad of the first retarding means is probably preferable. However, in the hand-grip-actuated electrically linked embodiments of FIG. 5 and FIG. 6, the electromagnetic braking of the second retarding means is probably preferable, whether linked by wire or by radio to the skater so long as adequate power is available and used.

Boot-actuation may be primary, as in the embodiment of FIG. 2, or may be for backup, as in the embodiment of FIG. 5. Conventional braking by tipping the skate backward on the rear wheel is available in all embodiments by means of the ellipsoidal protective pad shown. Its composition and those of other components are readily apparent and available generally, whether fibrous, elastomeric, of metallic.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

I claim:

1. Skater's apparatus for braking a roller skate having in line from front to rear of the skate a plurality of wheels adapted to support the skate on an underlying surface, comprising retarding means including a braking roller biased away from, but alternatively movable upon actuation by the skater, into braking contact with at least a rearmost one of the skate wheels;

actuation means including a hand grip manipulatable by the skater to actuate interconnecting linkage and thus to move the braking roller into braking contact with the skate wheel to retard wheel rotation as an intended braking of that skate wheel; and linkage means interconnecting the actuation means to the retarding means and enabling actuation by the skater to have such an intended braking effect upon the skate.

2. The apparatus of claim 1, wherein the interconnecting linkage is at least partly mechanical, and connects to a brake shoe, includes a connecting cable from the hand grip to a pivotal mounting of the brake shoe, and is adapted, upon actuation of the linkage, to move the braking roller into frictional braking contact with the skate wheel.

3. The apparatus of claim 1, wherein the interconnecting linkage is at least partly hydraulic, and connects to a brake shoe in frictional contact with the braking roller and adapted, upon actuation of the linkage, to move the braking roller into frictional braking contact with the skate wheel.

4. The apparatus of claim 1, wherein the interconnecting linkage is at least partly electrical, and connects to a brake shoe in frictional contact with the braking roller and adapted, upon actuation of the linkage, to move the braking roller into frictional braking contact with the skate wheel.

5. The apparatus of claim 3, wherein the interconnecting linkage includes a hydraulic amplifier.

6. The apparatus of claim 4, wherein the actuation means also includes a radio transmitter adapted to transmit a signal responsive to manipulation of the hand grip by the skater, and the linkage includes a radio receiver, and a servo-amplifier responsive to the signal received from the radio transmitter.

7. The apparatus of claim 6, wherein the boot of the skater supports a source of power for the servo-amplifier.

8. Skate wheel braking apparatus for a booted skater, comprising a portable radio transmitter, responsive to variation in manipulation of a hand-grip input component thereof by the skater, and adapted to transmit a correspondingly varying signal; and a portable radio receiver, mountable on the skater's boot, along with a servo-amplifier connected thereto, responsive to that varying output and further adapted to effectuate skate braking in accordance with signals as received from the transmitter.

9. The apparatus of claim 8, including a braking roller biased away from, but alternatively movable by an adjacent brake shoe, via action of the servo-amplifier, into frictional braking contact with at least a rearmost one of a plurality of supporting wheels of the skate.

10. The apparatus of claim 8, wherein the braking roller has adjacent electromagnetic braking means effective to retard it in accordance with signals as received from the transmitter and amplified by the servo-amplifier.

11. The apparatus of claim 9, wherein the receiver and servo mechanism are contained in a cylindrical housing having an upper end connected to a cuff of the skater's boot and having extending from its lower end a rod attached to pivot means for the brake shoe and adapted to vary its extension to effectuate such braking contact.

* * * * *